US009056457B2

(12) United States Patent
Hasegawa

(10) Patent No.: US 9,056,457 B2
(45) Date of Patent: Jun. 16, 2015

(54) IMAGE RECORDING APPARATUS

(71) Applicant: Shin Hasegawa, Nagoya (JP)

(72) Inventor: Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/803,845

(22) Filed: Mar. 14, 2013

(65) Prior Publication Data

US 2013/0321504 A1 Dec. 5, 2013

(30) Foreign Application Priority Data

May 29, 2012 (JP) ..... 2012-121486

(51) Int. Cl.
*B41J 2/15* (2006.01)
*B41J 2/045* (2006.01)
*B41J 19/14* (2006.01)

(52) U.S. Cl.
CPC ..... *B41J 2/04505* (2013.01); *B41J 19/145* (2013.01)

(58) Field of Classification Search
CPC ..... G06K 15/105; G06K 5/107
USPC ..... 347/41
See application file for complete search history.

(56) References Cited

U.S. PATENT DOCUMENTS

| | | | | |
|---|---|---|---|---|
| 5,500,661 | A * | 3/1996 | Matsubara et al. | 347/41 |
| 6,325,489 | B2 * | 12/2001 | Endo | 347/43 |
| 2001/0006392 | A1 * | 7/2001 | Otsuki | 347/9 |
| 2001/0017638 | A1 * | 8/2001 | Otsuki | 347/41 |
| 2004/0032454 | A1 * | 2/2004 | Kanda | 347/41 |
| 2004/0113976 | A1 * | 6/2004 | Katakura | 347/40 |
| 2011/0242174 | A1 * | 10/2011 | Kakutani | 347/15 |
| 2013/0257981 | A1 * | 10/2013 | Ito et al. | 347/37 |

FOREIGN PATENT DOCUMENTS

| | | | |
|---|---|---|---|
| JP | 3371567 | B2 * | 1/2003 |
| JP | 2010/162804 | | 7/2010 |
| JP | 2010162804 | A * | 7/2010 |

* cited by examiner

*Primary Examiner* — Shelby Fidler
(74) *Attorney, Agent, or Firm* — Frommer Lawrence & Haug LLP

(57) ABSTRACT

Nozzles for ejecting color ink are aligned in the conveying direction of a recording sheet at a pitch corresponding to three times the pitch of nozzles ejecting black ink. A region in which an image is printed is divided into sixteen regions segmented into four parts in the scanning and conveying directions. Each region includes eight dots in the scanning direction and four dots in the conveying direction. With respect to regions which include one character, in one side attachment regions, black ink is ejected only when an ink jet head is moved to the right side. With respect to regions which include one character, in the other side attachment regions, black ink is ejected only when the ink jet head is moved to the left side.

8 Claims, 11 Drawing Sheets

IMAGE RECORDING APPARATUS

CROSS-REFERENCE TO RELATED APPLICATIONS

This nonprovisional application claims priority under 35 U.S.C. §119(a) on Patent Application No. 2012-121486 filed in Japan on May 29, 2012, the entire contents of which are hereby incorporated by reference.

TECHNICAL FIELD

The present invention relates to an image recording apparatus in which ink is ejected from nozzles to record an image on a recording medium.

BACKGROUND

Japanese Patent Application Laid-Open No. 2010-162804 discloses an image forming apparatus in which an image is recorded by ejecting ink from nozzles while an ink jet head reciprocates in a scanning direction. In the ink jet head disclosed in Japanese Patent Application Laid-Open No. 2010-162804, nozzles for black are arranged with a density of 600 dpi while nozzles for color are arranged with a density of 300 dpi. In other words, the nozzles for black are arranged with a pitch corresponding to a half of the pitch of the nozzles for color. When an image is recorded using both black ink and color ink, a series of operations are repeatedly performed in which the ink jet head is moved in the scanning direction while ink is ejected from the nozzles for black and color, and thereafter a recording sheet is conveyed by a distance corresponding to five times the pitch of the nozzles for black.

Here, in Japanese Patent Application Laid-Open No. 2010-162804, the black nozzles are divided into two black nozzle groups arranged one after another, and ink is alternately ejected from the black nozzles belonging to one and the other of the two groups at each timing of ink ejection. Alternatively, ink is ejected only from the nozzles belonging to one group while the ink jet head is moved to one side in the scanning direction, and ink is ejected only from the nozzles belonging to the other group while the ink jet head is moved to the other side in the scanning direction. By thus performing image recording, all the black nozzles have a chance to eject ink while the ink jet head is moved once in the scanning direction, so that the black nozzles can be prevented from being dry.

SUMMARY

Here, in the image forming apparatus disclosed in Japanese Patent Application Laid-Open No. 2010-162804, in the case where an image is recorded by ejecting ink from nozzles as described above, dots formed by the ink ejected when the ink jet head is moved to one side in the scanning direction and dots formed by the ink ejected when the ink jet head is moved to the other side in the scanning direction are alternately positioned in at least one of the scanning direction and the conveying direction of a recording sheet (see FIGS. 6, 7, 10 and 12 in Japanese Patent Application Laid-Open No. 2010-162804).

When, on the other hand, ink is ejected from nozzles while the ink jet head reciprocates in the scanning direction, an attachment position of the ink ejected from nozzles while the ink jet head is moved to one side in the scanning direction and an attachment position of the ink ejected from nozzles while the ink jet head is moved to the other side in the scanning direction may not be aligned, with each other in the scanning direction.

Thus, in the image forming apparatus according to Japanese Patent Application No. 2010-162804, in the case where an image is recorded which includes a line extending in the conveying direction of a recording sheet such as a vertical line of a character or a vertical line of a table, dots formed by the ink ejected when the ink jet head is moved to one side in the scanning direction and dots formed by the ink ejected when the ink jet head is moved to the other side in the scanning direction that are placed adjacent to each other in the conveying direction of the recording sheet may form lines extending in the conveying direction out of alignment for each part in the scanning direction. Moreover, in the case where the dots formed by ink ejected while the ink jet head is moved to one side in the scanning direction and the dots formed by ink ejected while the ink jet head is moved to the other side in the scanning direction are arranged adjacent to each other in the scanning direction, the resulting line extending in the conveying direction of the recording sheet may have undesired thickness. This leads to degradation in image quality.

An object is to provide an image recording apparatus which can record an image including a line extending in the conveying direction of a recording medium with high quality while preventing the nozzles from being dry.

An image recording apparatus according to the first aspect is an image recording apparatus, comprising: an ink jet head which includes a plurality of nozzles ejecting ink while moving in a main scanning direction; a conveyance section conveying a recording medium to which ink ejected from the plurality of nozzles is attached, in a sub-scanning direction perpendicular to the main scanning direction; and a control section controlling operation of the ink jet head and the conveyance section, wherein the plurality of nozzles include a plurality of first nozzles which are aligned at a first pitch P1 with respect to the sub-scanning direction and a plurality of second nozzles which are aligned at a second pitch P2 (P2=nP1, n is an integer more than 1) with respect to the sub-scanning direction and eject ink of a type different from ink ejected from the plurality of the first nozzles, the aligned first and second nozzles being arranged in parallel with respect to the main scanning direction, wherein the control section performs control to repeatedly execute a unit recording operation for recording an image in a unit recording region of the recording medium extending in the main scanning direction by alternately executing one side recording operation for ejecting ink from the first nozzles and the second nozzles while moving the ink jet head to one side in the main scanning direction and the other side recording operation for ejecting ink from the first nozzles and the second nozzles while moving the ink jet head to the other side in the main scanning direction for n times and by conveying the recording medium by a length equal to the first pitch P1 or a length obtained by adding multiplication of the second pitch P2 by an integer to the first pitch P1 in the sub-scanning direction every time any one of the one side recording operation and the other side recording operation is executed, so as to record an image on the recording medium, wherein, in the one side recording operation, ink is attached to a one side attachment region which is a part of the unit recording region and in which a plurality of dots formed by the attached ink are aligned with respect to the main scanning direction, wherein, in the other side recording operation, ink is attached to the other side attachment region which is a part of the unit recording region and a part other than the one side attachment region and in which a plurality of dots are aligned with respect to the main scanning direction, and wherein the one side attachment region and the other side attachment region are determined so that the one side attachment regions and the other side attachment regions corresponding to an arbitrary unit recording operation and at least one unit recording operation among unit recording operations just before and after the arbitrary unit recording operation are in contact with each other with respect to the sub-scanning direction, respectively, for at least a part of the regions.

An image recording apparatus according to the second aspect is an image recording apparatus, comprising: an ink jet head ejecting ink from a plurality of nozzles while reciprocating in a predetermined scanning direction; a conveyance mechanism conveying a recording medium to which ink ejected from the plurality of nozzles is attached, in a conveying direction perpendicular to the scanning direction; and a control device controlling operation of the ink jet head and the conveyance mechanism, wherein the ink jet head includes a plurality of first nozzles aligned at a predetermined first pitch with respect to the conveying direction and a plurality of second nozzles aligned at a second pitch with respect to the conveying direction which is a pitch corresponding to a number obtained by multiplying the first pitch by a predetermined integer more than 1 and ejecting ink of a type different from ink ejected from the plurality of first nozzles, as the plurality of nozzles, wherein the control device performs control to repeatedly execute a unit recording operation for recording an image in a unit recording region of the recording medium extending in the scanning direction by alternately executing one side recording operation for ejecting ink from the first nozzles and the second nozzles while moving the ink jet head to one side in the scanning direction and the other side recording operation for ejecting ink from the first nozzles and the second nozzles while moving the ink jet head to the other side in the scanning direction for predetermined integer times and by conveying the recording medium by a length equal to the first pitch or a length obtained by adding multiplication of the second pitch by an integer to the first pitch in the conveying direction every time any one of the one side recording operation and the other side recording operation is executed, so as to record an image on the recording medium, wherein, in the one side recording operation, ink is attached to a one side attachment region which is a part of the unit recording region and in which a plurality of dots formed by the attached ink are aligned with respect to the scanning direction, wherein, in the other side recording operation, ink is attached to the other side attachment region which is an image recording region and a part other than the one side attachment region and in which a plurality of dots are aligned with respect to the scanning direction, and wherein the one side attachment region and the other side attachment region are determined so that the one side attachment regions and the other side attachment regions corresponding to an arbitrary unit recording operation and at least one unit recording operation among unit recording operations just before and after the arbitrary unit recording operation are overlapped with each other with respect to the conveying direction, respectively, for at least a part of the regions.

According to the configuration, ink is ejected from the first nozzles in any one of the one side recording operation and the other side recording operation. This can prevent the first nozzles with a pitch smaller than a pitch of the second nozzles from being dry. Moreover, only the ink ejected by one side recording operation is attached to the one side attachment region, while only the ink ejected by the other side recording operation is attached to the other side attachment region. Thus, only the ink ejected while the ink jet head is moved to the same direction is attached to each of the one side attachment region and the other side attachment region. In the one side attachment region and the other side attachment region, therefore, the dots formed by the attached ink will not cause misalignment in the scanning direction due to the difference in the moving directions of the ink jet head. Accordingly, in the case where a line extending in the conveying direction is recorded, the line can be recorded with a desired thickness.

Furthermore, in the present configuration, at least one portion of at least two or more one side attachment regions overlap with each other in the conveying direction, while at least one portion of at least two or more other side attachment regions overlap with each other in the conveying direction. Thus, to these two or more one side attachment regions and two or more other side attachment regions, only the ink ejected while the ink jet head is moving in the same direction is attached. Accordingly, in the case where a line extending in the conveying direction is recorded across the two or more one side attachment regions, and across the two or more other side attachment regions, the line extending across different portions will not have misalignment for each part in the scanning direction.

According to the above description, an image including a line extending in the conveying direction can be recorded with high quality.

According to the configuration, the first nozzles with a smaller pitch can be prevented from being dry, while an image including a line extending in the conveying direction can be recorded with high quality.

The above and further objects and features will more fully be apparent from the following detailed description with accompanying drawings.

DETAILED DESCRIPTION

A preferred embodiment will be described below.

Figure 1:
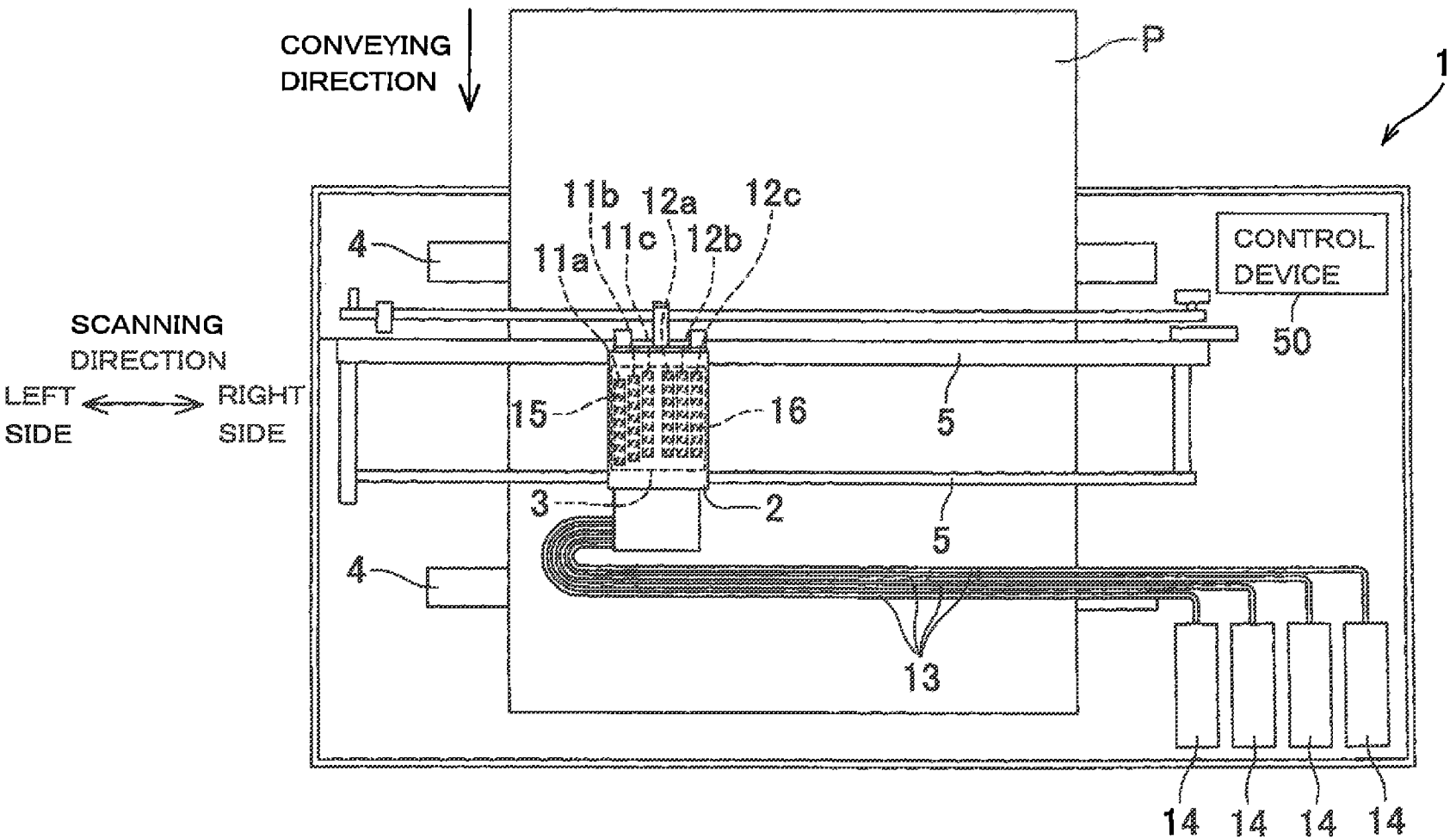
FIG. 1 is a schematic configuration diagram of a printer according to an embodiment.
Figure 2:
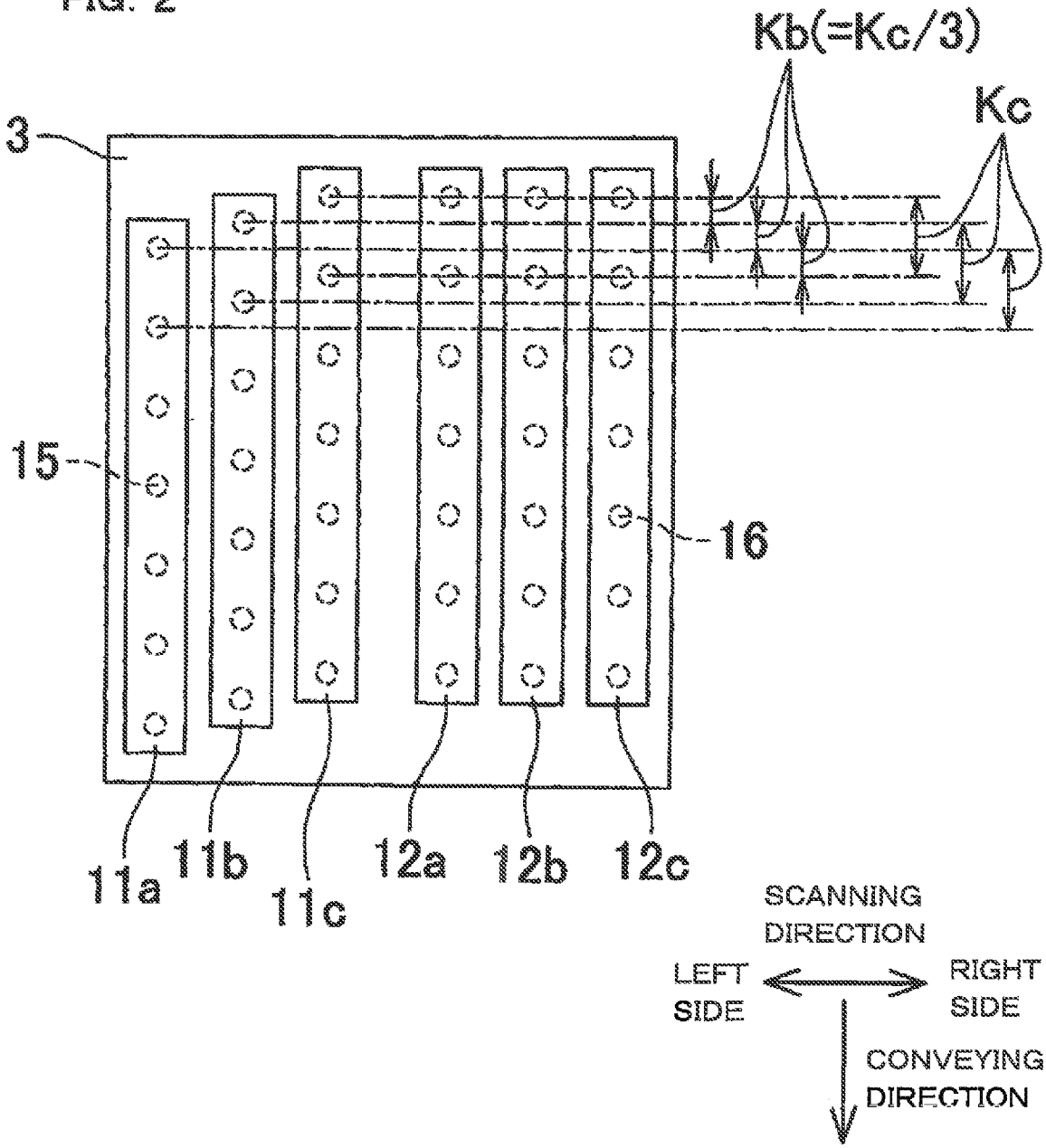
FIG. 2 is a diagram illustrating a positional relationship of nozzles at an ink jet head shown in FIG. 1.

As shown in FIG. 1, the printer 1 according to the present embodiment includes a carriage 2, an ink jet head 3, a sheet conveying roller 4 and the like. Moreover, the operation of the printer 1 is controlled by a control device (control section) 50.

The carriage 2 reciprocates in a scanning direction (main scanning direction) along two guide rails 5. Note that the right side and the left side in the scanning direction are defined as shown in FIG. 1 in the description below. The ink jet head 3 is mounted on the carriage 2 and is provided with three black head units 11*a* to 11*c*, and three color head units 12*a* to 12*c*.

The three black head units 11*a* to 11*c* are arranged in the scanning direction and respectively include a plurality of black nozzles 15 aligned at a pitch Kc in a conveying direction (sub-scanning direction) perpendicular to the scanning direction. Moreover, the black head unit 11*b* is arranged at a position displaced from the black head unit 11*a* toward the upper stream in the conveying direction by a pitch Kb which is a third of the pitch Kc (=Kc/3). The black head unit 11*c* is arranged at a position displaced from the black head unit 11*b* toward the upper stream in the conveying direction by the pitch Kb. Thus, at the ink jet head 3, the black nozzles 15 are aligned at the pitch Kb with respect to the conveying direction.

In the present embodiment, as described above, the three black head units 11*a* to 11*c* each including black nozzles 15 aligned at the pitch Kc are displaced from one another in the conveying direction by the pitch Kb of the black nozzles 15, so that the black nozzles 15 are aligned at the pitch Kb. It is, however, also possible to provide one black head unit with the black nozzles 15 aligned at the pitch Kb instead of the three black head units 11*a* to 11*c*.

The three color head units 12*a* to 12*c* are aligned in the scanning direction and respectively include a plurality of color nozzles 16 aligned at the pitch Kc in the conveying direction perpendicular to the scanning direction. Moreover, the three color head units 12*a* to 12*c* are not displaced from one another in the conveying direction, so that the color nozzles 16 of the three color head units 12*a* to 12*c* are positioned at the same positions as the black nozzles 15 of the black head unit 11*c* with respect to the conveying direction.

Furthermore, the ink jet head 3 is connected to four ink cartridges 14 through tubes 13. The four ink cartridges 14 have ink of black, yellow, cyan and magenta stored therein in this order from the right side of the scanning direction. The ink of four colors is supplied to the ink jet head 3 through the tubes 13.

The ink jet head 3 ejects the four-color ink supplied from the ink cartridges 14. More specifically, the black ink is ejected from the black nozzles 15 of the black head units 11*a* to 11*c*, while the ink of yellow, cyan and magenta is ejected from the color nozzles 16 of color head units 12*a* to 12*c*, respectively.

The sheet conveying roller 4 conveys a recording sheet P in the conveying direction. In the printer 1, the carriage 2 is moved to the right side or to the left side in the scanning direction while scanning is performed in which ink is ejected from the ink jet head 3 mounted on the carriage 2, and the recording sheet P is conveyed with the sheet conveying roller 4 in the conveying direction by a predetermined amount every time the scanning is performed. By repeating such operations, an image is recorded on the recording sheet P.

Figure 3:
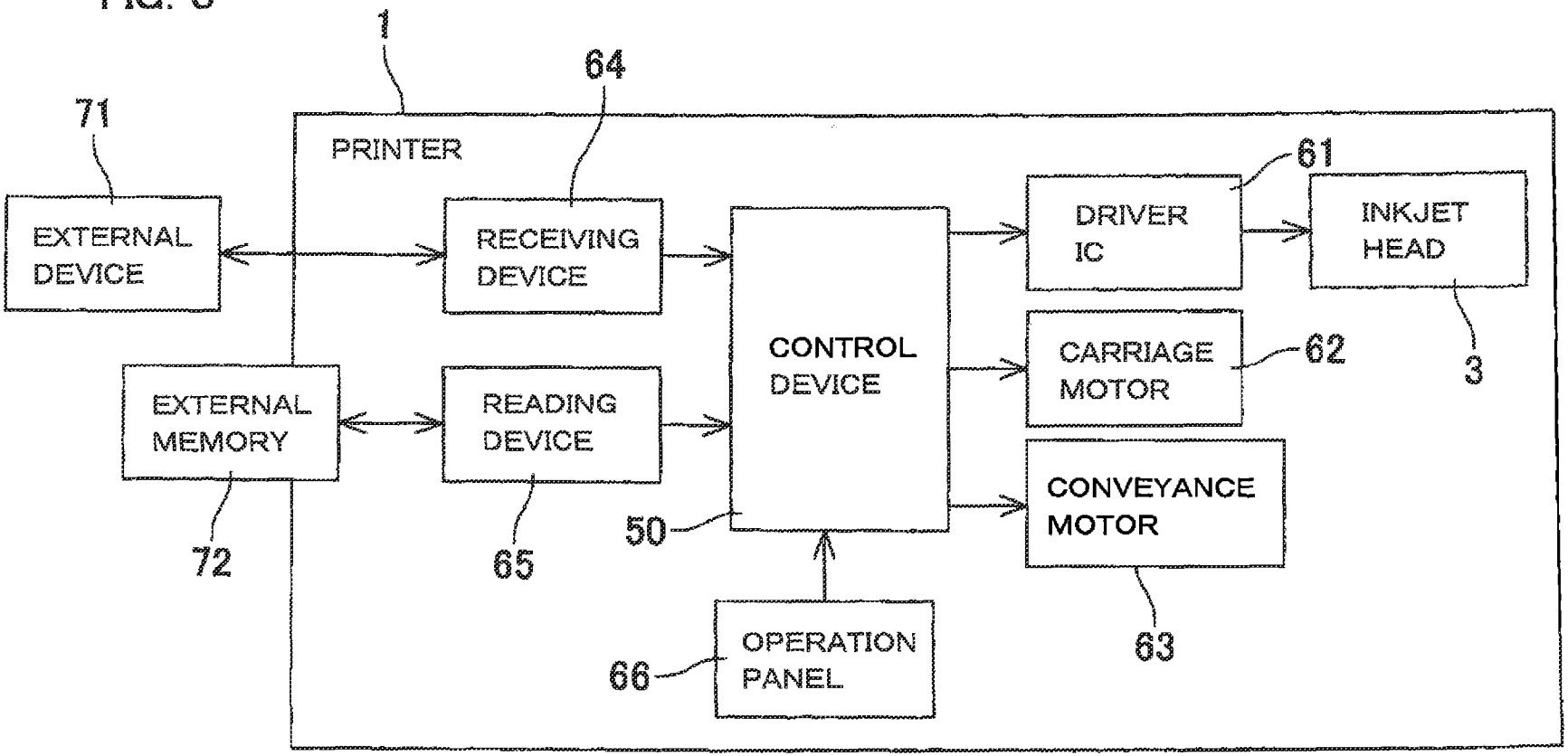
FIG. 3 is a hardware block diagram illustrating a hardware configuration of the printer according to the embodiment.

Next, a hardware configuration of the printer 1 will be described with reference to FIG. 3. As shown in FIG. 3, the printer 1 includes a control device 50, a driver IC 61, a carriage motor 62, a conveyance motor 63, an ink jet head 3, a receiving device 64, a reading device 65 and an operation panel 66.

The receiving device 64 is an interface for receiving various types of data transmitted from an external device 71 such as a PC to the printer 1. More specifically, the receiving device 64 is a well-known network card, a USB device controller or the like. The reading device 65 is a controller for reading various types of data stored in an external memory 72 such as a portable storage like a memory card, or a digital camera. More specifically, the reading device 65 is a well-known memory controller, a USB host controller or the like. The operation panel 66 includes a display and various types of operation buttons for operation by the user. The user can operate the operation panel 66 to input different instructions to the printer 1.

The control device 50 includes various types of control circuits including a CPU (Central Processing Unit), a ROM (Read Only Memory), a RAM (Random Access Memory), an ASIC (Application Specific Integrated Circuit) and the like. The control device 50 performs various types of processing such as recording control processing, image data acquisition processing, mode information acquisition processing, mode determination processing, region change processing and the like in accordance with various types of programs stored in a memory such as ROM or RAM.

The recording control processing is for controlling the operations of, for example, the driver IC 61 for driving the ink jet head 3, the carriage motor 62 for moving the carriage 2, the conveyance motor 63 for driving the sheet conveying roller 4, when an image is recorded at the printer 1. The control device 50 controls the driver IC 61, the carriage motor 62, the conveyance motor 63 and the like to selectively record an image in any one of the first to third recording modes described later.

The image data acquisition processing is for acquiring image data transmitted from the external device 71 such as a PC to the printer 1. The control device 50 acquires image data, for example, through the receiving device 64 described above. The external device 71 such as a PC creates image data which can be printed at the printer 1 and transmits the created image data to the printer 1 when, for example, the user gives an instruction to record a desired electronic file. Note that the image data may be data described in a page descriptive language or may be data of an image file in a predetermined format such as JPEG which can be decrypted by the printer 1.

The mode information acquisition processing is for acquiring mode information indicating which one of the first to third recording modes described later is set to record an image on a recording sheet P. The control device 50 acquires the mode information, for example, through the receiving device 64 described above. It is noted that the mode information in the present embodiment may be data created by the printer driver of the external device 71 when an instruction for printing is given by the external device 71 such as a PC. The external device 71 transmits the mode information along with the image data described above to the printer 1. Note that the mode information acquired by the control device 50 may be data described in a page descriptive language or may be data described at the header of an image file in a predetermined format such as JPEG.

The printer driver in the external device 71 may generate mode information, indicating which recording mode is set for printing, in accordance with various types of print setting and a file format of an original electronic file. For example, it may be so configured that the user can select a desired recording mode among the first to third recording modes with a GUI of the printer driver and that the printer driver generates mode information based on the selected recording mode. The user may directly set a recording mode of the user's choice among the first to third recording modes.

Moreover, instead of the user directly setting any one of the first to the third recording modes, the printer driver may generate mode information indicating any one of the first to third recording modes based on print setting of another item input by the user. For example, it may be configured that "monochrome/color setting" can be selected on the GUI of the printer driver. In the item of "monochrome/color setting," either one of "monochrome printing" or "color printing" may be selected for print setting. When "monochrome printing" is being set, the printer driver may generate mode information indicating the third recording mode. When, on the other hand, "color printing" is being set, the printer driver may generate mode information indicating either the first recording mode or the second recording mode based on the file format of an original electronic file designated for printing. More specifically, in the case of forming a file such as spreadsheet software or word processing software that uses a line extending in the conveying direction such as characters, ruled lines or the like, mode information indicating the first recording mode may be generated. If, on the other hand, the file format of the original electronic file is an image file such as TIFF or GIF, mode information indicating the second recording mode may be generated.

The mode determination processing is to determine which one of the first to third recording modes described later is set to record an image on a recording sheet P in the printer 1 based on the mode information acquired at the mode information acquisition processing. The details of the determination processing will be described later.

The region change processing is for changing positions of regions A1-A4, B1-B4, C1-C4 and D1-D4, which will be described later, on the recording sheet P in the case where the recording is performed in the first recording mode described later. The change of regions may be performed, for example, in accordance with a result of an instruction for changing regions given by the user operating the operation panel 66 or the external device 71. Alternatively, it may also be performed in accordance with, for example, the size of a character in an image to be recorded. In the case where the control device includes a changing section for changing positions of one side attachment region and the other side attachment region, the positions of the one side attachment region and the other side attachment region can be changed in accordance with, for example, the position of a line extending in the conveying direction included in an image to be recorded.

Recording of an image in the first to third recording modes as described above will now be described. The first recording mode is to record a color image by ejecting black ink and color ink superposed on one another on a recording sheet P.

Figure 4:
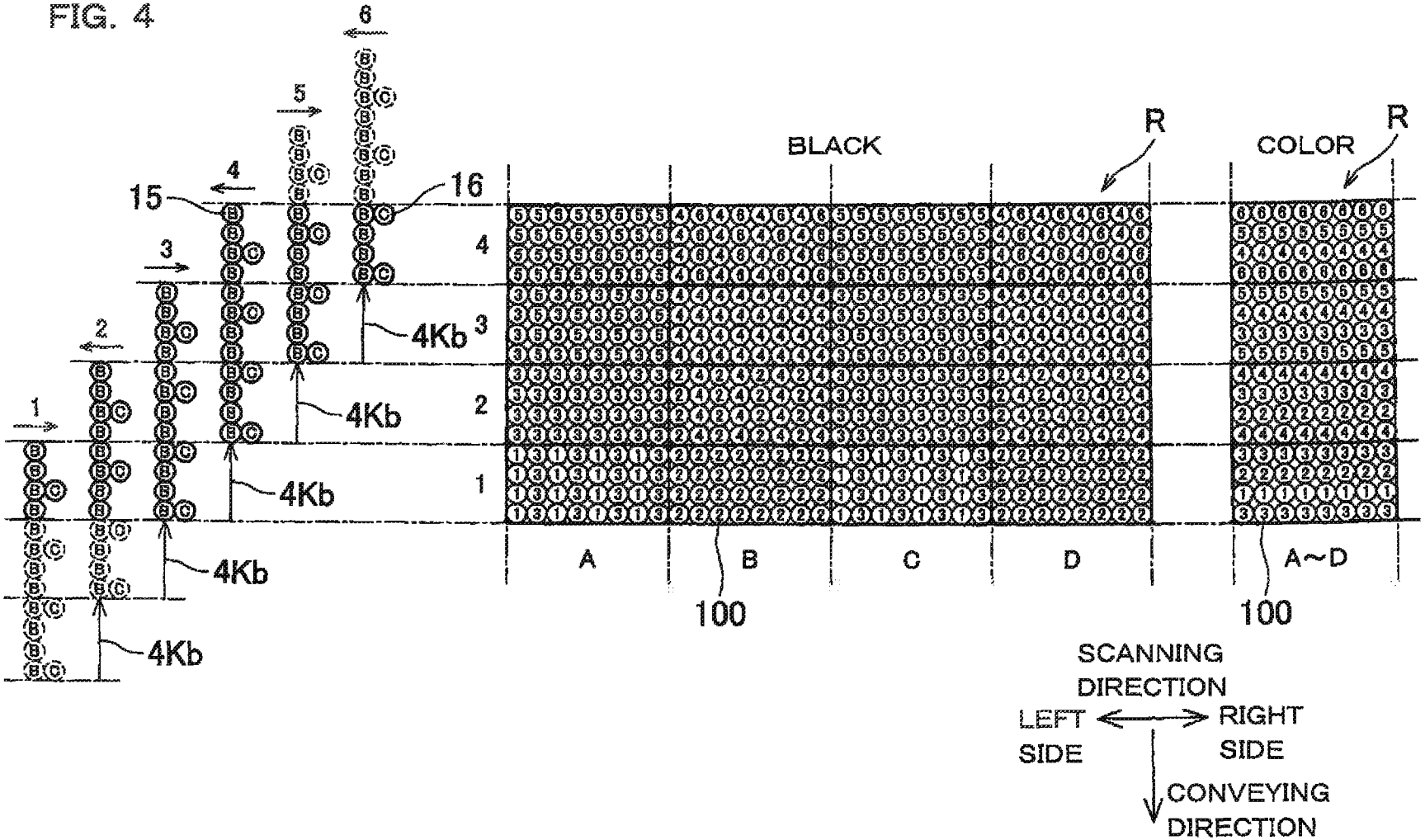
FIG. 4 is a diagram illustrating nozzles for ejecting ink and a position where ink is attached when an image is recorded in the first recording mode.

The left side view in FIG. 4 schematically shows a positional relationship of black nozzles 15 and color nozzles 16 in each scanning operation of the first recording mode as well as the nozzles 15 and 16 which eject ink. In this view, the circled "B" corresponds to the black nozzles 15 for the three black head units 11*a* to 11*c*. Moreover, the circled "C" corresponds to the color nozzles 16 for the three color head units 12*a* to 12*c*. Each of the numbers 1 through 6 at the upper side in this view indicates which number of times the scanning corresponds to. The arrow shown below each of the numbers indicates the moving direction of the carriage 2 in each scanning operation. Moreover, in this view, the nozzles 15 and nozzles 16 ejecting ink at each scanning are indicated by solid lines, while the nozzles 15 and nozzles 16 not ejecting ink are indicated by broken lines.

The right side view in FIG. 4 schematically shows a position of a dot 100 formed by the ink ejected at each scanning being attached when an image is recorded in the first recording mode. In this view, a circled number indicates which number of times the scanning corresponds to when ink is ejected to form the dot. Here, though the attachment position of black ink and the attachment position of color ink are separately shown in the drawing, the black ink and color ink are ejected overlapping with each other on at least a part of an image to be recorded. Furthermore, as for the color ink, the dots 100 formed by each scanning have the same positions in any one of the regions A1 through D1 described later, so that FIG. 4 shows these positions in one drawing. The same applies to the regions A2 through D2, regions A3 through D3, and regions A4 through D4 described later.

Though, at the printer 1, in practice, a recording sheet P is conveyed in the conveying direction without a change in the position of the ink jet head 3 in the conveying direction, the position of the recording sheet P is fixed in FIG. 4 to clearly show the position of the ink jet head 3 on the basis of the recording sheet P in order to clearly indicate the position of dots 100 formed at each scanning. Moreover, FIG. 4 shows an example where an image is recorded by six scanning operations in a region R in which thirty-two dots 100 are aligned in the scanning direction and sixteen dots 100 are aligned in the conveying direction.

Here, in the present embodiment, the region R is divided into four by four in the scanning direction and in the conveying direction respectively as shown in FIG. 4, to obtain sixteen segmented regions each including eight dots 100 in the scanning direction and four dots in the conveying direction. Note that, in the description below, the sixteen regions are represented by alphabets A through D for indicating the position of a region counted from left and numbers 1 through 4 for indicating the position of a region counted from downstream in the conveying direction. For example, a region which is the second from left and the third from downstream in the conveying direction will be represented as B3.

Figure 5A:
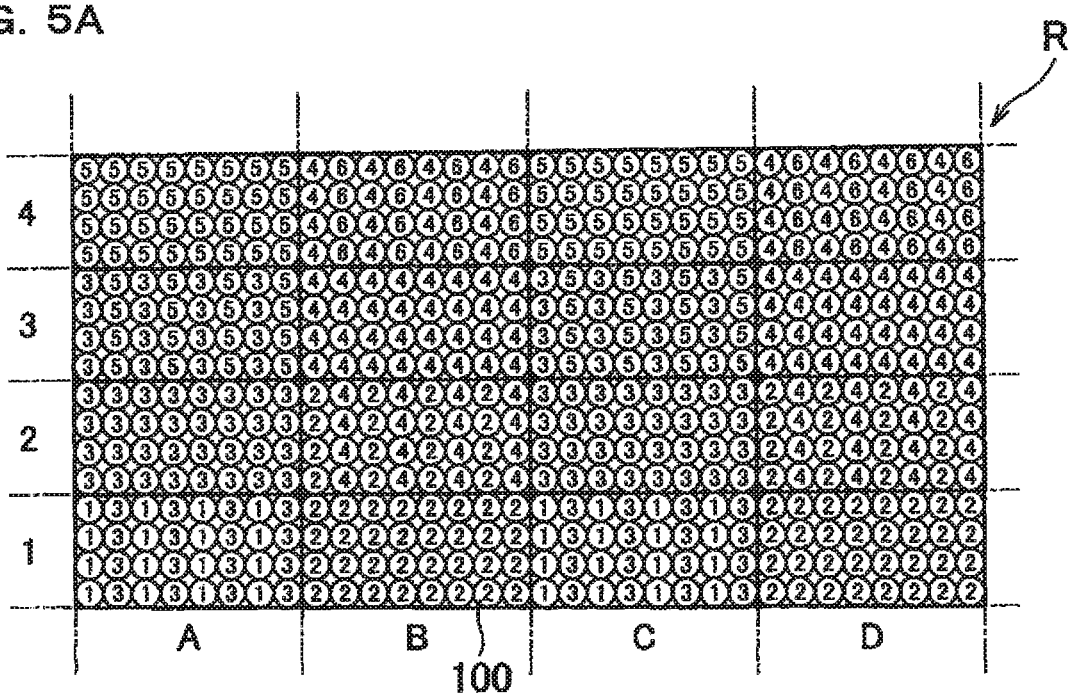
FIGS. 5A and 5B are diagrams illustrating an example of segmented regions when an image is recorded in the first recording mode.
Figure 5B:
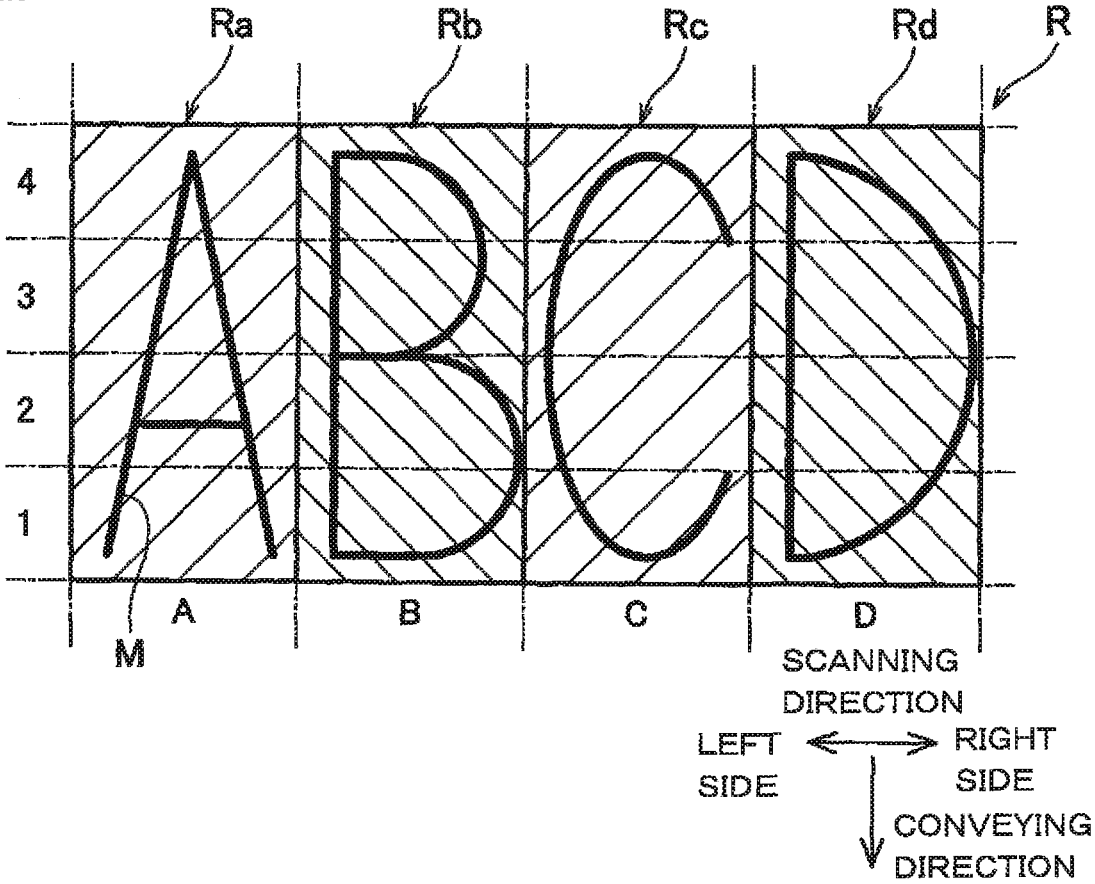

Moreover, in the present embodiment, in the region change processing described above, the position of the sixteen regions are so changed as to include one character M in each of a region Ra which is the combination of regions A1 through A4, a region Rb which is the combination of regions B1 through B4, a region Rc which is the combination of regions C1 through C4 and a region Rd which is the combination of regions D1 through D4, as shown in bold lines of FIG. 5B.

In the first recording mode, the first scanning is executed in which ink is ejected from the black nozzles 15 and the color nozzles 16 while moving the carriage 2 to the right side. Here, as for the black ink, only the ink forming the odd number dots 100 from left in the regions A1 and C1 is ejected. As for the color ink, on the other hand, the ink forming the second dot 100 from the downstream in the conveying direction in each of the regions A1 through D1 is ejected.

Next, a recording sheet P is conveyed in the conveying direction by 4Kb which is a length corresponding to four times the pitch Kb of black nozzles 15. In other words, the recording sheet P is conveyed by a length Kb+Kc obtained by adding the pitch Kb of black nozzles 15 to the pitch Kc (=3Kb) of color nozzles 16. Subsequently, the second scanning is performed in which ink is ejected from the black nozzles 15 and color nozzles 16 while moving the carriage 2 to the left side. Here, as for the black ink, only the ink forming dots 100 in the regions B1 and D1 as well as the odd number dots 100 from left in the regions B2 and D2 is ejected. As for the color ink, on the other hand, the ink forming the third dot 100 from the downstream in the conveying direction in each of the regions A1 through D1 and forming the second dot 100 from the downstream in the conveying direction in each of the regions A2 through D2 is ejected.

Next, the recording sheet P is conveyed in the conveying direction by 4Kb. Subsequently, the third scanning is performed in which ink is ejected from the black nozzles 15 and color nozzles 16 while moving the carriage 2 to the right side.

Here, as for the black ink, only the ink forming the even number dots 100 from left in the regions A1 and C1, the dots 100 in the regions A2 and C2, and the odd number dots 100 from left in the regions A3 and C3 is ejected. As for the color ink, on the other hand, the ink forming the first and fourth dots from the downstream in the conveying direction in each of the regions A1 through D1, the third dot 100 from the downstream in the conveying direction in each of the regions A2 through D2, and the second dot 100 from the downstream in the conveying direction in the regions A3 through D3 is ejected.

Next, the recording sheet P is conveyed in the conveying direction by 4Kb. Subsequently, the fourth scanning is performed in which ink is ejected from the black nozzles 15 and color nozzles 16 while moving the carriage 2 to the left side. Here, as for the black ink, only the ink forming the even number dots 100 from left in the regions B2 and D2, the dots 100 in the regions B3 and D3, and the odd number dots 100 from left in the regions B4 and D4 is ejected. As for the color ink, on the other hand, the ink forming the first and fourth dots 100 from the downstream in the conveying direction in each of the regions A2 through D2, the third dot 100 from the downstream in the conveying direction in each of the regions A3 through D3, and the second dot 100 from the downstream in the conveying direction in the regions A4 through D4 is ejected.

Next, the recording sheet P is conveyed in the conveying direction by 4Kb. Subsequently, the fifth scanning is performed in which ink is ejected from the black nozzles 15 and color nozzles 16 while moving the carriage 2 to the right side. Here, as for the black ink, only the ink forming the even number dots 100 from left in the regions A3 and C3 as well as the dots 100 in the regions A4 and C4 is ejected. As for the color ink, on the other hand, the ink forming the first and fourth dots 100 from the downstream in the conveying direction in each of the regions A3 through D3 as well as the third dot 100 from the downstream in the conveying direction in each of the regions A4 through D4 is ejected.

Next, the recording sheet P is conveyed in the conveying direction by 4Kb. Subsequently, the sixth scanning is performed in which ink is ejected from the black nozzles 15 and color nozzles 16 while moving the carriage 2 to the left side. Here, as for the black ink, only the ink forming the even number dots 100 from left in the regions B4 and D4 is ejected. As for the color ink, on the other hand, the ink forming the first and fourth dots 100 from the downstream in the conveying direction in each of the regions A4 through D4 is ejected.

Figure 6:
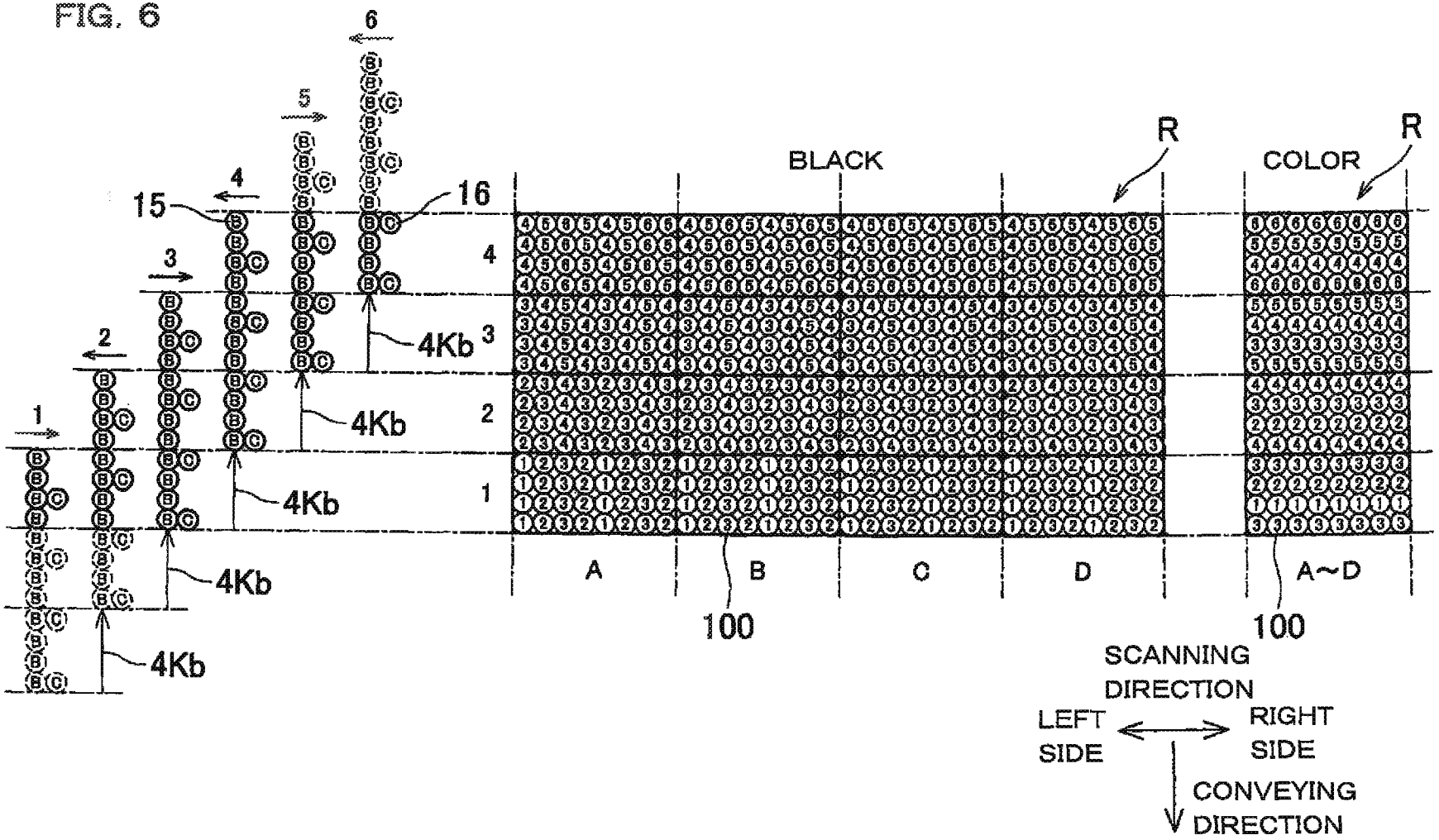
FIG. 6 is a diagram illustrating nozzles for ejecting ink and positions where ink is attached when an image is recorded in the second recording mode.

The second recording mode is now described. The second recording mode is different from the first recording mode, and for recording a color image by ejecting black and color ink overlapped with each other on the recording sheet P. FIG. 6 is a diagram corresponding to FIG. 4 in the second recording mode. Also in the second recording mode, six scanning operations are performed to record an image in the region R as in the first recording mode. The attachment position of black ink at each scanning is, however, different from that in the first recording mode. Since the attachment position of color ink at each scanning in the second recording mode is similar to that in the first recording mode, description is made only for black ink here. Also in the second recording mode, the recording sheet P is conveyed by 4Kb in the conveying direction at each scanning, as in the first recording mode.

In the second recording mode, as for the black ink, at the first scanning, only the ink forming the first and fifth dots 100 from left is ejected in each of the regions A1 through D1. At the second scanning, only the ink forming the even number dots 100 from left in the regions A1 through D1 as well as the first and fifth dots 100 from left in each of the regions A2 through D2 is ejected. Moreover, at the third scanning, only the ink forming the third and seventh dots from left in each of the regions A1 through D1, the even number dots 100 from left in each of the regions A2 through D2, and the first and fifth dots 100 from left in each of the regions A3 through D3 is ejected. At the fourth scanning, only the ink forming the third and seventh dots 100 from left in each of the regions A2 through D2, the even number dots 100 from left in each of the regions A3 through D3, and the first and fifth dots 100 from left in each of the regions A4 through D4 is ejected. At the fifth scanning, only the ink forming the third and seventh dots 100 from left in each of the regions A3 through D3, and the even number dots from left in the regions A4 through D4 is ejected. Moreover, at the sixth scanning, only the ink forming the third and seventh dots 100 from left in each of the regions A4 through D4 is ejected.

As described above, in the first and second recording modes, among the six scanning operations, an image is recorded in the regions A1 through D1 by the first through third scanning operations, an image is recorded in the regions A2 through D2 by the second through fourth scanning operations, an image is recorded in the regions A3 through D3 by the third through fifth scanning operations, and an image is recorded in the regions A4 through D4 by the fourth through sixth scanning operations. Moreover, in the first and second recording modes, there is a chance for each of the black nozzles 15 to eject ink at least once in the three scanning operations. This can prevent the black nozzles 15, which are arranged at a pitch smaller than that of the color nozzles 16, from being dry.

Figure 7:
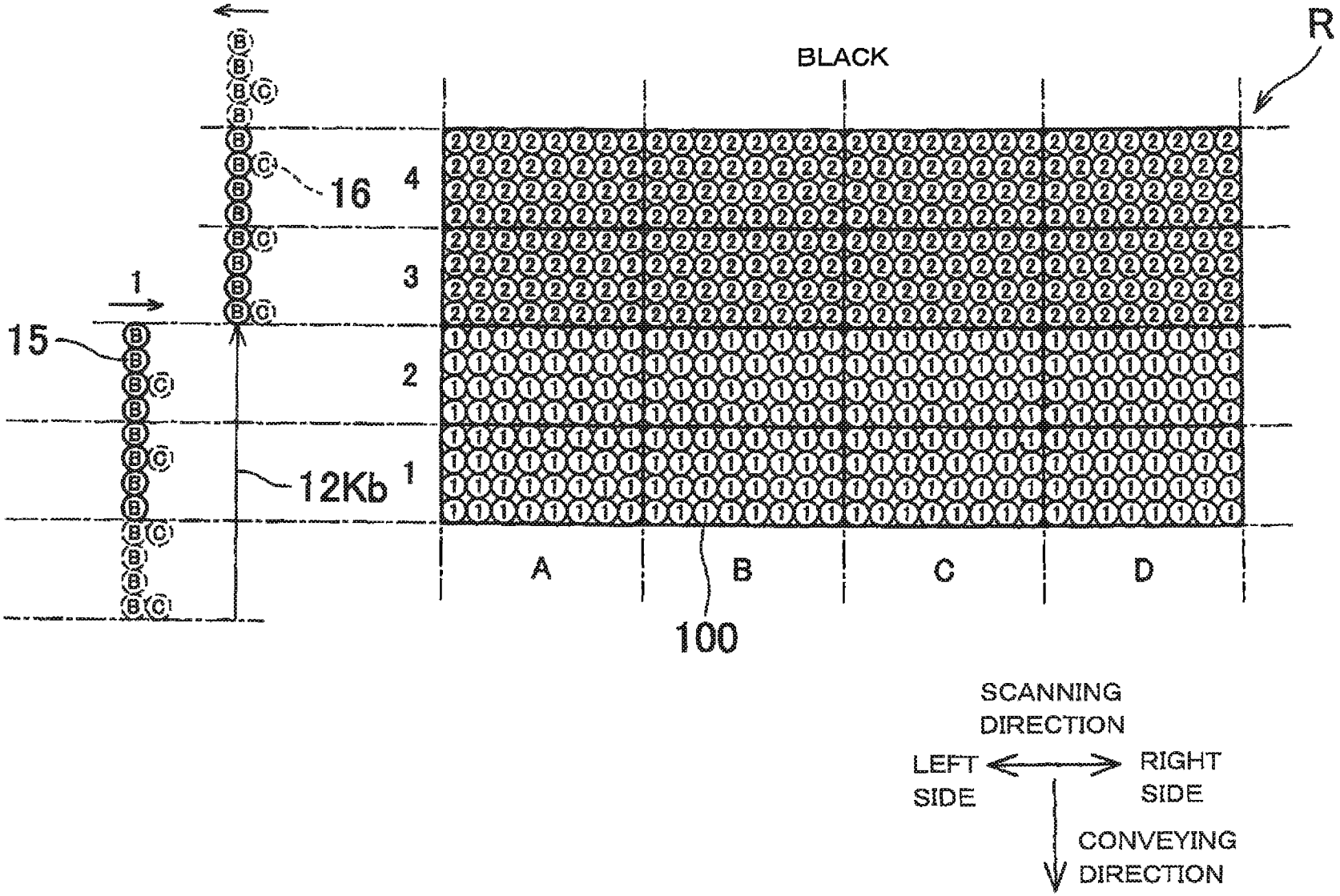
FIG. 7 is a diagram illustrating nozzles for ejecting ink and positions where ink is attached when an image is recorded in the third recording mode.

The third recording mode is now described. The third recording mode is for recording a monochrome image by using only black ink. FIG. 7 is a diagram corresponding to FIG. 4 in the third recording mode.

In the third recording mode, the first scanning is executed in which ink is ejected from the black nozzles 15 while moving the carriage 2 to the right side. Here, ink is ejected only from the black nozzles 15 set in the regions A1 through D1 and A2 through D2 with respect to the conveying direction.

Next, the recording sheet P is conveyed in the conveying direction by the length of a column of black nozzles 15, i.e., the length 12Kb which is twelve times the pitch Kb. Subsequently, the second scanning is executed in which ink is ejected from the black nozzles 15 while moving the carriage 2 to the left side. Here, with respect to the conveying direction, ink is ejected only from the black nozzles 15 set in the regions A3 through D3 and A4 through D4.

In the third recording mode, as described above, a monochrome image is recorded in the region R by the two scanning operations at a resolving power corresponding to the pitch Kb of black nozzles 15. That is, a monochrome image can be recorded at a speed higher than that in the first and second recording modes and at the same resolving power as that in the first and second recording modes.

Here, in the present embodiment, an image can selectively be recorded in any one of the first to third recording modes. Among them, either the first recording mode or the second recording mode allows an image to be recorded by ejecting black ink and color ink to be overlapped with each other. Here, the difference in image quality between an image recorded in the first recording mode and an image recorded in the second recording mode is described.

In the first recording mode, as shown in FIG. 4 and FIG. 5A, the dots 100 in the regions A1 through A4 and C1 through C4 are formed only by the ink ejected by odd numbered scanning operations. That is, the dots 100 are formed only by the ink ejected while the carriage 2 is being moved to the right side.

Likewise, the dots 100 in each of the regions B1 through B4 and D1 through D4 are formed only by the ink ejected by even numbered scanning operations. In other words, the dots 100 are formed only by the ink ejected while the carriage 2 is being moved to the left side.

Accordingly, in each of the regions A1 through A4, regions B1 through B4, regions C1 through C4, and regions D1 through D4, the dots 100 formed by the ink ejected while the carriage 2 is moving in the same direction are aligned in the scanning direction and the conveying direction.

Furthermore, also in each of the region Ra which is the combination of the regions A1 through A4, the region Rb which is the combination of the regions B1 through B4, the region Rc which is the combination of the regions C1 through C4, and the region Rd which is the combination of the regions D1 through D4, the dots 100 formed by the ink ejected while the carriage is being moved in the same direction are aligned in the scanning direction and conveying direction.

Here, in the case where an image is recorded by ejecting ink from the nozzles 15 and 16 while the carriage 2 reciprocates in the scanning direction, the attachment position of the ink is somewhat displaced in the scanning direction when ink is ejected while moving the carriage 2 to the right side and when ink is ejected while moving it to the left side.

Thus, unlike the first recording mode, in the case where a line extending in the conveying direction, such as one character and a vertical line in a table, is recorded in a region in which the dots 100 formed by the ink ejected while the carriage 2 is being moved to the right side and the dots 100 formed by the ink ejected while the carriage 2 is being moved to the left side are aligned in the conveying direction, the line may be out of alignment for each part in the scanning direction.

Moreover, unlike the first recording mode, in the case where a line extending in the conveying direction is recorded in a region in which the dots 100 formed by the ink ejected while the carriage 2 is being moved to the right side and the dots 100 formed by the ink ejected while the carriage 2 is being moved to the left side are aligned in the scanning direction, the line may not have a desired thickness.

When recording is performed in the first recording mode, on the contrary, one character M constituting an image is set in each of the regions Ra, Rb, Rc and Rd, so that the line forming the character M will not be displaced for each part in the scanning direction. Moreover, the line will have a desired thickness. This allows an image including a line extending in the conveying direction to be recorded with high quality.

When, on the other hand, an image is recorded in the second recording mode, in the regions A1 through A4, B1 through B4, C1 through C4 and D1 through D4, the dots 100 formed by the ink ejected by odd numbered scanning operations and the dots formed by the ink ejected by even numbered scanning operations are alternately aligned in the scanning direction. Furthermore, in each of the regions Ra, Rb, Rc and Rd, four groups of dots 100 aligned in the conveying direction formed by the ink ejected by odd numbered scanning operations and four groups of dots 100 aligned in the conveying direction formed by the ink ejected by even numbered scanning operations are alternately aligned in the conveying direction.

Comparing with the first recording mode, therefore, as the entire region R, the dots 100 formed by the ink ejected by odd numbered scanning operations and the dots 100 formed by the ink ejected by even numbered scanning operations are uniformly arranged. Thus, in the case of recording a photograph and the like, an image to be recorded can have a uniform image quality.

Next, the operation of the control device 50 performed when an instruction for recording is received from the external device 71 will be described with reference to FIG. 8.

Figure 8:
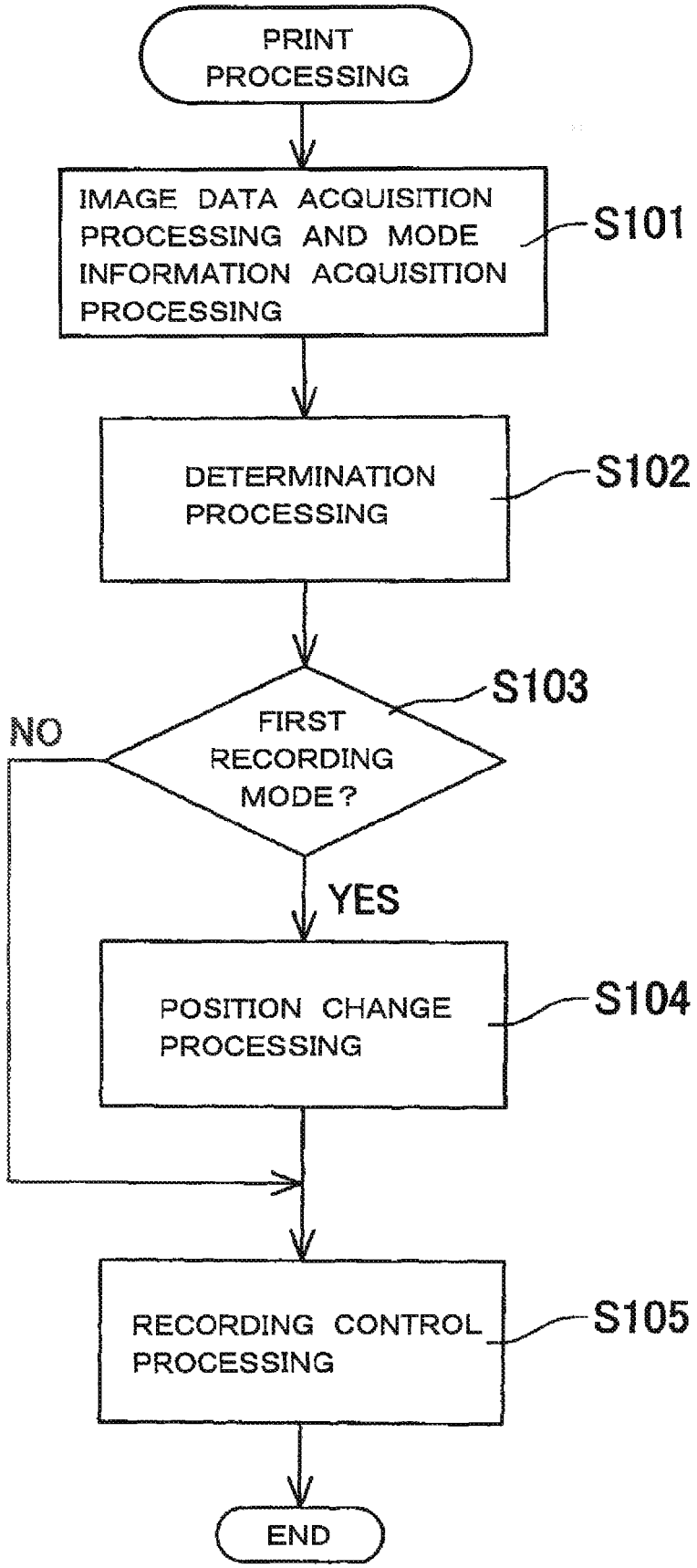
FIG. 8 is a flowchart illustrating a procedure of print processing.

In the case where the receiving device 64 receives an instruction for recording image data, the control device 50 starts print processing shown in FIG. 8. When the print processing is started, the control device 50 performs image data acquisition processing and mode information acquisition processing (S101). After image data and mode information are acquired, the control device 50 performs mode determination processing (S102). After determining which recording mode is set to record image data, if the determined recording mode is the first recording mode (S103: YES), the control device 50 performs position change processing (S104) and then performs recording in the first recording mode (S105). If, on the other hand, the recording mode determined at S102 is the second or third recording mode (S103: NO), the control device 50 performs recording in the determined recording mode (S105). If a plurality of pieces of image data are divided and received for one printing instruction, at S105, acquisition of the subsequent image data and recording of the image data are repeatedly executed.

In the present embodiment, an image can be recorded in any desired recording mode among the first through third recording modes. In the third recording mode, a monochrome image can rapidly be recorded with high resolving power. In the first recording mode, on the other hand, a line extending in the conveying direction can be recorded with high quality when an image including the line extending in the conveying direction such as a character or a table is recorded with color ink. This is advantageous when, for example, printing a file used in spreadsheet software which includes an image to be recorded containing a table with background-color and is assumed to preferably have high quality in a vertical line in a table or a line of a character. In the second recording mode, on the other hand, when the ink to be ejected has high duty, such as when a file format acquired by a mode information acquisition part 53 is a photograph file format, the black nozzles can be prevented from being dry and thus a clear image can be recorded.

Moreover, in the present embodiment, when an image is recorded in the first recording mode, positions of the regions A1 through A4, B1 through B4, C1 through C4 and D1 through D4 can be changed in the position change processing. Thus, changing the positions of the regions A1 through A4, B1 through B4, C1 through C4 and D1 through D4 according to the positions of a character or a vertical line, the recording quality of a character or a line in a table can be higher independent of an image to be recorded.

Note that, in the present embodiment, the black nozzles 15 correspond to the first nozzles, while the color nozzles 16 correspond to the second nozzles. Moreover, the sheet conveying roller 4 corresponds to a conveyance mechanism (conveyance section). The pitch Kb corresponds to the first pitch, while the pitch Kc corresponds to the second pitch.

Furthermore, the right side in the scanning direction corresponds to one side according to the present embodiment. The operation of ejecting ink from the nozzles 15 and 16 while moving the carriage 2 to the right side in the first recording mode corresponds to one side recording operation according to the present embodiment. Each of the regions A1 through A4 and C1 through C4 to which black ink ejected by one side recording operation is attached corresponds to one side attachment region according to the present embodiment.

Moreover, the left side in the scanning direction corresponds to the other side. The operation of ejecting ink from the nozzles 15 and 16 while moving the carriage 2 to the left side in the first recording mode corresponds to the other side recording operation. Each of the regions B1 through B4 and D1 through D4 to which the black ink ejected by the other side recording operation is attached corresponds to the other side attachment region.

Moreover, the three sequential scanning operations and the conveyance of the recording sheet P performed during these scanning operations together correspond to a unit recording operation. Each of the region which is the combination of the regions A1 through D1, the region which is the combination of the regions A2 through D2, the region which is the combination of the regions A3 through D3, and the region which is the combination of the regions A4 through D4 in which recording is performed by the three sequential scanning operations corresponds to the unit recording region.

A modification in which various changes are added to the present embodiment will now be described. A configuration similar to the present embodiment, however, will not be described as appropriate.

Though it was described in the embodiment above that the control device 50 acquires information directly indicating a recording mode itself as mode information at S101, it is not limited thereto. For example, information related to another print setting may also be utilized as the mode information described above. More specifically, information related to setting of two items of "monochrome/color setting" and "vertical line setting" may be used as the mode information. These print settings can appropriately be set by the user with the use of CUI of a printer driver, and an external device may transmit the information for these print settings to the printer 1 together with image data. The "monochrome/color setting" is set in the same manner as in the description above. In the item of "vertical line setting," either one of "priority to vertical line such as character" or "priority to image such as photograph" may be selected.

In such a case, at S101 described above, the control device 50 acquires information related to these settings as the mode information through the receiving device 64 as described above. At S102, the control device 50 determines which recording mode is set for recording based on these pieces of information received at S101. It is noted that the "vertical line setting" may not necessarily be set directly by the user. For example, the printer driver may perform such setting on the basis of the file format of an original image file designated for printing.

Though it was described in the embodiment above that the control device 50 is to acquire information directly indicating a recording mode itself as the mode information, it is not limited thereto. For example, image data itself may be utilized as the mode information.

Here, the control device 50 acquires only image data at S101 described above. Then, at S102, it is determined which recording mode is set among the first through third recording modes based on the image data acquired at S101. More specifically, it is determined, for example, (i) which one of a monochrome image and a color image is suitable to be recorded, and (ii) whether or not a line extending in the conveying direction, such as a vertical line of a character or a vertical line in a table, is included in the image, based on the image acquired at S101. The determination on (i) is made depending on whether or not data other than black is included in the image data. The determination on (ii) is made depending on, for example, whether or not a character or the like is included in a received image with pattern matching.

Though it was described in the embodiment above that the control device 50 receives image data through the receiving device 64, it is not limited thereto. For example, image data may also be acquired through a reading device 65 from the external memory 72 such as a memory card in which an image file of a predetermined format which can be printed on the printer 1 is stored as image data. Here, when an instruction is given for printing image data stored in the external memory 72 with the operation panel 66 after the user connects the reading device 65 to the external memory 72, the control device 50 starts the print processing described above.

Here, the control device 50 acquires image data through the reading device 65 at S101. Note that the external memory 72 may not necessarily store the mode information in advance. The operation panel 66 may accept the selection of a mode by the user on a screen for printing instruction of the operation panel 66. The control device 50 acquires mode information through the operation panel 66. It is then determined at S102 which recording mode among the first through third modes is set for recording based on the mode information acquired through the operation panel 66.

Though it was described that a recording mode can directly be designated with the operation panel 66, it may also be designated indirectly using another setting. Alternatively, a recording mode may automatically be determined by analyzing the image acquired at S101 without designating a recording mode by the operation on the operation panel 66.

Figure 9:
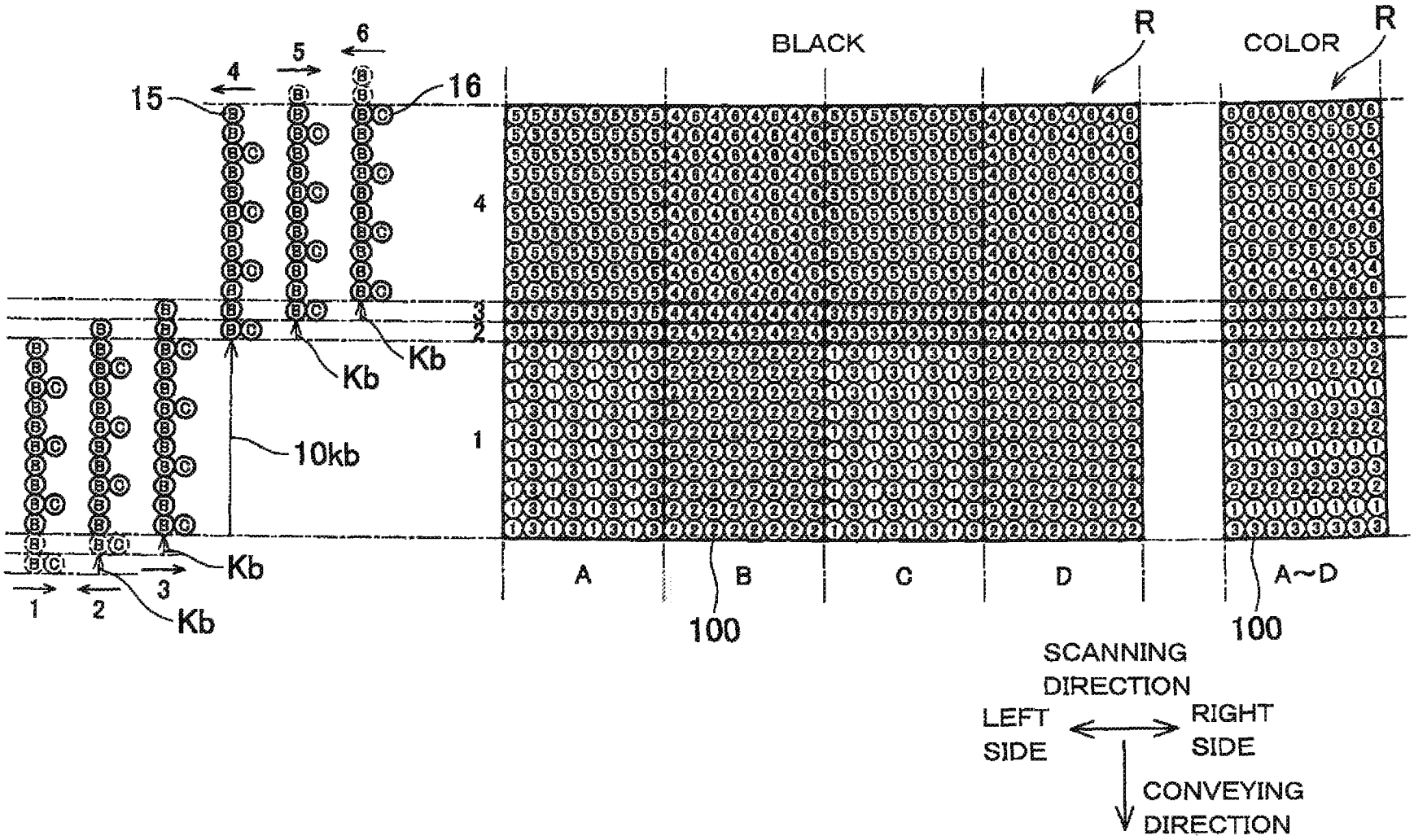
FIG. 9 is a diagram corresponding to FIG. 4 of Modification 1.

Though the recording sheet P is conveyed by the length of 4Kb every time scanning is performed in the embodiment described above, it is not limited thereto. In one modification (Modification 1), for example, in the first and second recording modes, the recording sheet P is conveyed by the same length as the pitch Kb after each of the first and second scanning operations as well as the fourth and fifth scanning operations, while the recording sheet P is conveyed by the length of 10Kb which is ten times the pitch Kb, i.e., the length of Kb+3Kc obtained by adding the length of three times the pitch Kc to the pitch Kb, after the third scanning. Note that FIG. 9 shows an example in the first recording mode.

In such a case, however, each of the regions A1 through D1 and A4 through D4 is set as a region in which ten dots are aligned in the conveying direction, while each of the regions A2 through D2 and A3 through D3 is set as a region in which only one dot is arranged in the conveying direction.

Moreover, the amount of conveyance of the recording sheet P after each scanning operation in the first and second recording modes is not limited to the one described in the example above but may correspond to any length which is equal to the pitch Kb or which is obtained by adding a number corresponding to integer times of the pitch Kc to the pitch Kb. Here, the length of each of the regions A1 through A4, B1 through B4, C1 through C4 and D1 through D4 in the conveying direction is determined by the amount of conveyance of the recording sheet P.

Though it was described in the embodiment above that each of the regions A1 through A4, B1 through B4, C1 through C4 and D1 through D4 may include eight dots 100 aligned in the scanning direction, the number of dots 100 is not limited thereto. Each of the regions A1 through A4, B1 through B4, C1 through C4 and D1 through D4 may include a plurality of number other than eight of dots 100 aligned in the scanning direction. Furthermore, the number of dots 100 that can be aligned in the scanning direction in each of the regions may be different from each other.

Though, in the embodiment described above, the pitch Kc of the color nozzles 16 corresponds to three times the pitch Kb of the black nozzles 15, it is not limited thereto. For example, the pitch Kr of the color nozzles 16 may be obtained by multiplying the pitch Kb of black nozzles 15 by an odd number which is not less than five, or may be obtained by multiplying the pitch Kb of black nozzles 15 by an even number.

Figure 10:
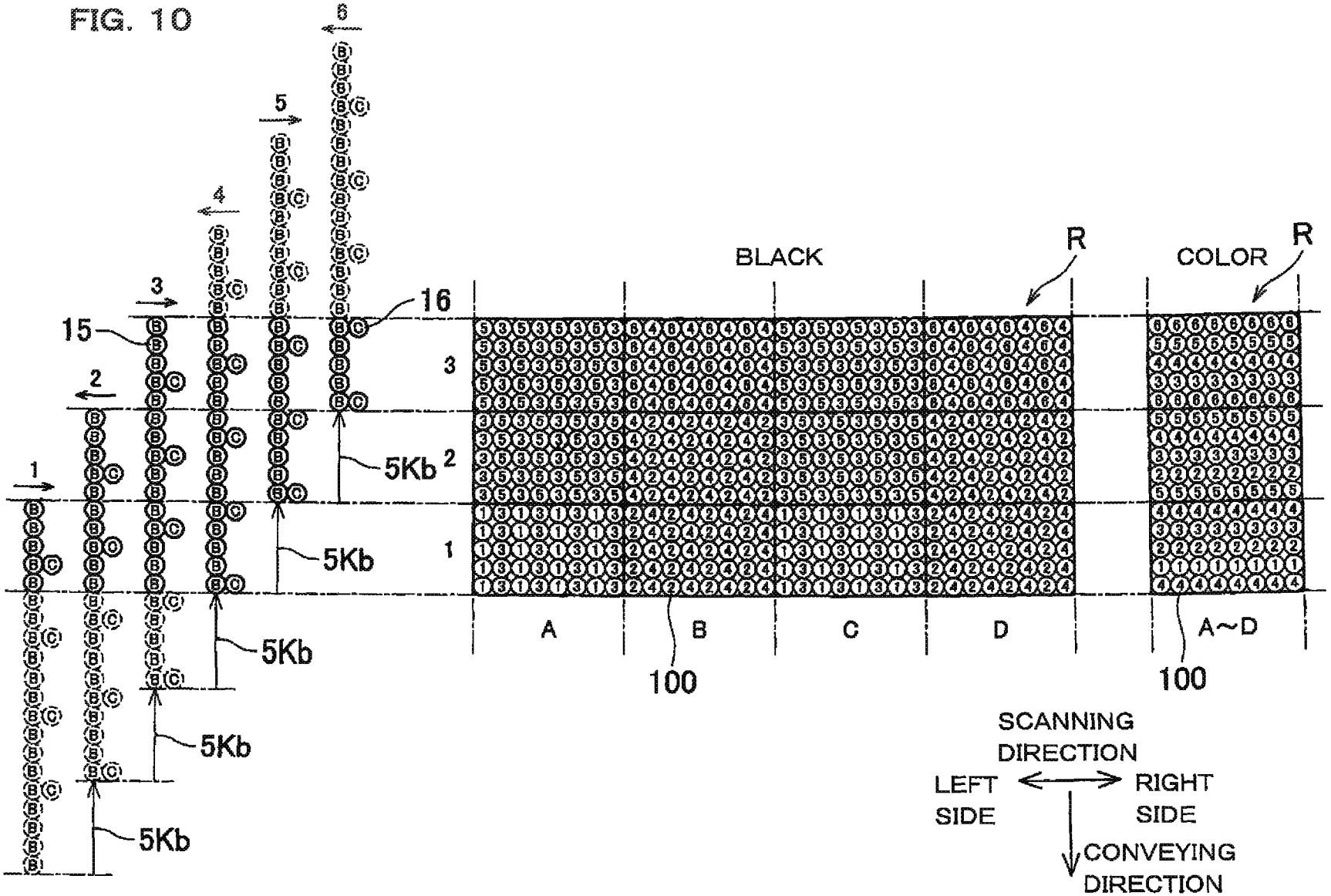
FIG. 10 is a diagram corresponding to FIG. 4 of Modification 2.

In an example where the pitch Kc of color nozzles 16 corresponds to a number obtained by multiplying the pitch Kb of the black nozzles 15 by an even number, in one modification (Modification 2), as shown in FIG. 10, the pitch Kr of color nozzles 16 corresponds to four times the pitch Kb of the black nozzles 15, i.e., Kc=4Kb.

In such a case, as shown in FIG. 10, the region R is a region in which fifteen dots 100 can be aligned in the conveying direction, and is divided into three regions each including five dots 100 in the conveying direction.

As for the black ink, ink is ejected in the first scanning only for the odd number dots 100 from left in each of the regions A1 and C1. Moreover, in the second scanning, only the ink forming the odd number dots 100 from left in each of the regions B1 and D1 as well as the even number dots 100 from left in each of the regions B2 and D2 is ejected. Moreover, at the third scanning, only the ink forming the even number dots from left in each of the regions A1, C1, A3 and C3 as well as the odd number dots 100 from left in each of the regions A2 and C2 is ejected. At the fourth scanning, only the ink forming the even number dots 100 from left in each of the regions B1, D1, B3 and D3 as well as the odd number dots 100 from left in each of the regions B2 and D2 is ejected. Moreover, at the fifth scanning, only the ink forming the even number dots 100 from left in each of the regions A2 and C2 as well as the odd number dots 100 from left in each of the regions A3 and C3 is ejected. Furthermore, at the sixth scanning, only the ink forming the odd number dots 100 from left in each of the regions B3 and D3 is ejected.

As for the color ink, on the other hand, at the first scanning among the four sequential scanning operations recording an image to each of the regions A1 through D1, A2 through D2 and A3 through D3, the ink forming the second dot 100 from downstream in the conveying direction is ejected. Moreover, at the next scanning, the ink forming the third dot 100 from downstream in the conveying direction is ejected. At the subsequent scanning, the ink forming the fourth dot 100 from downstream in the conveying direction is ejected. Then, at the last scanning, the ink forming the first and fifth dots 100 from downstream in the conveying direction is ejected.

Here, after each scanning, the recording sheet P is conveyed in the conveying direction by the length of 5Kb corresponding to five times the pitch Kb, i.e., by the length of Kb+Kc obtained by adding the pitch Kc of color nozzles 16 to the pitch Kb of black nozzles.

Figure 11A:
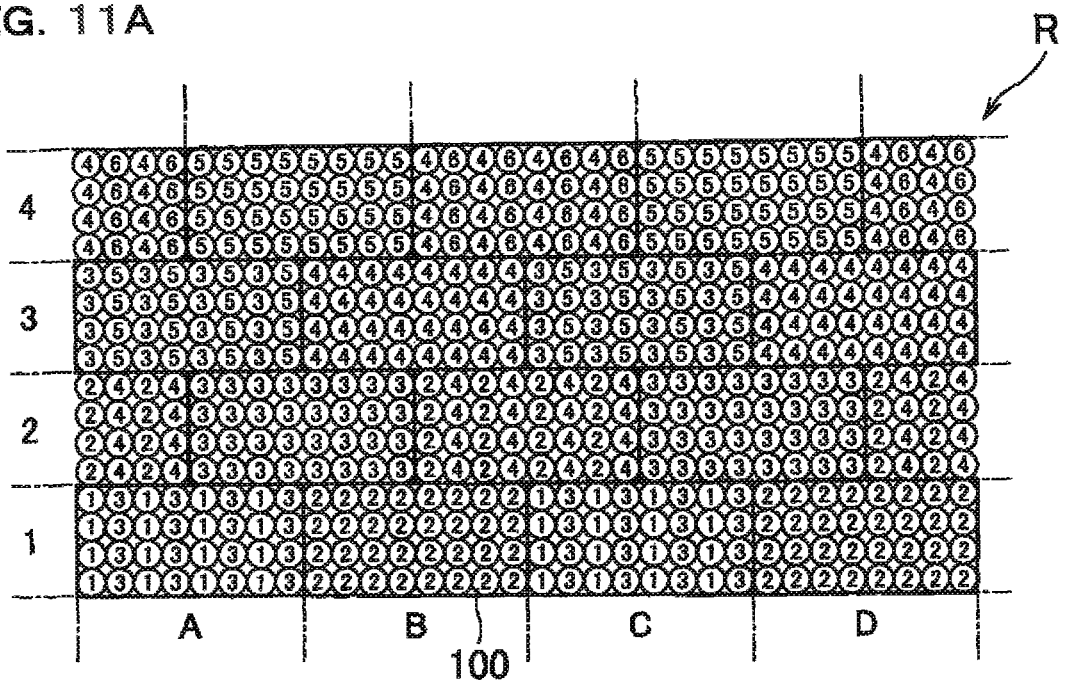
FIGS. 11A and 11B are diagrams corresponding to FIGS. 5A and 5B of Modification 3.

Though, in the embodiment described above, each of the regions A1 through A4, B1 through B4, C1 through C4 and D1 through D4 is completely overlapped (contacted) with one another in the conveying direction, the arrangement is not limited thereto. These regions may be arranged in any manner as long as they overlap with each other at least at a part thereof. In one modification (Modification 3), as shown in FIG. 11A, the regions A2 and A4 are displaced with respect to the regions A1 and A3 by four dots 100, so that the substantial right half of the region A1 and the substantial left half of the region A2 overlap with each other, the substantial left half of the region A2 and the substantial right half of the region A3 overlap with each other, and the substantial right half of the region A3 and the substantial left half of the region A4 overlap with each other in the conveying direction. Same applies to the regions B1 through B4, regions C1 through C4, and regions D1 through D4.

Figure 11B:
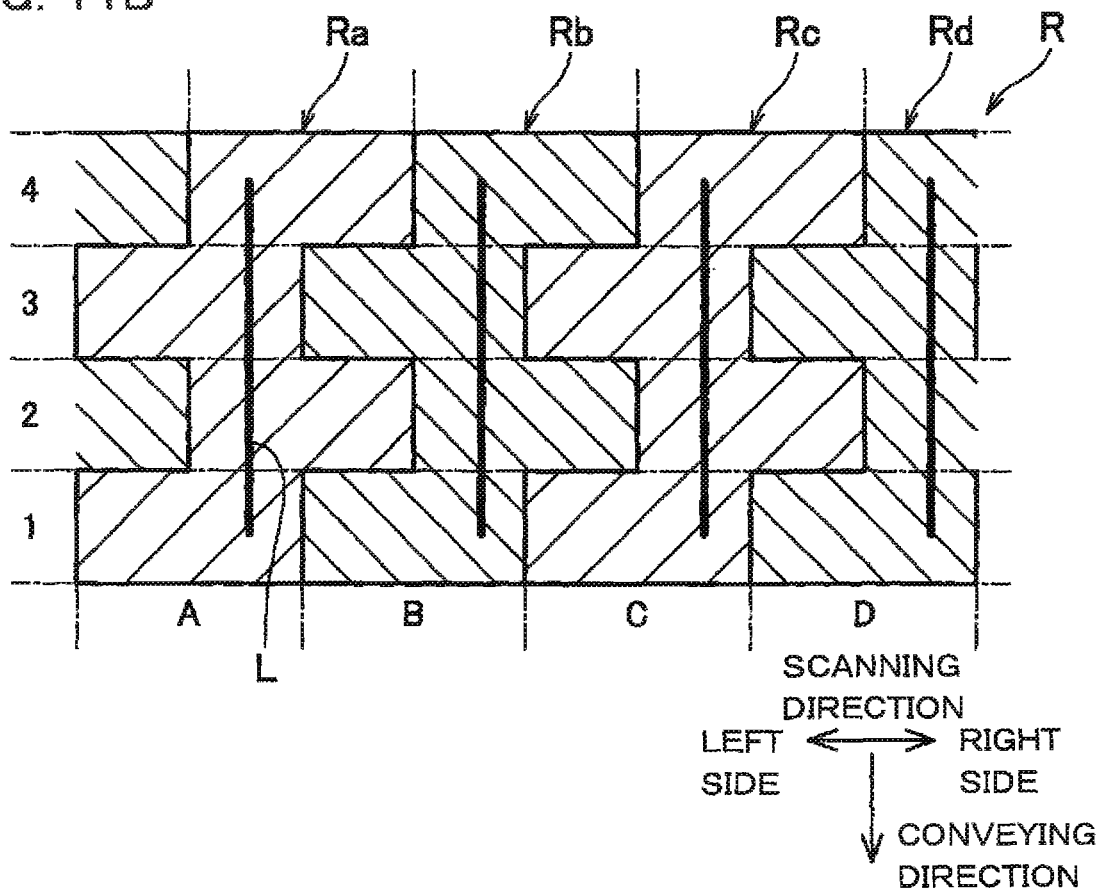

In such a case, if, for example, the positions of the regions are so determined that a straight line L extending in the conveying direction is positioned in a portion where the regions A1 through A4 of the region Ra overlap with each other in the conveying direction, a portion where the regions B1 through B4 of the region Rb overlap with each other in the conveying direction, a portion where the regions C1 through C4 of the region Rc overlap with each other in the conveying direction, and a portion where the regions D1 through D4 of the region Rd overlap with each other in the conveying direction, as shown in FIG. 11B, parts of the straight line L will not be displaced from one another in the scanning direction, as in the embodiment described above. Moreover, the straight line L can be recorded with a desired thickness.

Furthermore, it is not limited that each of the one side attachment regions and the other side attachment regions overlap with each other in the conveying direction over the entire area of the recording sheet P in the conveying direction. Each of the one side attachment regions may overlap with at least one of the one side attachment regions adjacent thereto at upstream and downstream in the conveying direction. Each of the other side attachment regions may overlap with at least one of the other side attachment regions adjacent thereto at upstream and downstream in the conveying direction.

Though, in the embodiment described above, the positions of the regions A1 through A4, B1 through B4, C1 through C4 and D1 through D4 can be changed by the position change processing, the position of these regions may not necessarily be changed. In this case also, for example, when the printer is used mainly for recording an image including a line extending in the conveying direction with its position hardly changed, such an image including a character, the image including the line can be recorded with high quality if the positions of regions are set in accordance with the position of the line extending in the conveying direction beforehand.

Furthermore, though the color nozzles 16 are arranged at the same positions as the black nozzles 15 in the black head unit 11*c* with respect to the conveying direction in the embodiment described above, the arrangement is not limited thereto. The color nozzles 16 may be arranged at the same position as the black nozzles 15 in the black head unit 11*a* or the black nozzles 15 in the black head unit 11*b* with respect to the conveying direction.

Though an example was described for the application to a printer including the ink jet head 3 having the black nozzles 15 for ejecting black ink and the color nozzles 16 for ejecting color ink, the application is not limited thereto. The combination of a type of ink ejected from the first nozzles aligned at the predetermined first pitch and a type of ink ejected from the second nozzles aligned at the second pitch which is obtained by multiplying the first pitch by a predetermined integer may be a combination other than black and color ink.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image recording apparatus, comprising:

an ink jet head which includes a plurality of nozzles ejecting ink while moving in a main scanning direction;

a conveyance section conveying a recording medium to which ink ejected from the plurality of nozzles is attached, in a sub-scanning direction perpendicular to the main scanning direction; and a control section controlling operation of the ink jet head and the conveyance section;

wherein the plurality of nozzles include:

a plurality of first nozzles which are aligned at a first pitch P1 with respect to the sub-scanning direction; and a plurality of second nozzles which are aligned at a second pitch P2 (P2=nP1, n is an integer more than 1) with respect to the sub-scanning direction and eject ink of a type different from ink ejected from the plurality of the first nozzles;

the aligned first and second nozzles being arranged in parallel with respect to the main scanning direction;

wherein the control section performs control to alternately execute a one-side recording operation and an other-side recording operation for n times;

wherein the control section performs control in the one-side recording operation to eject ink from the first nozzles while moving the ink jet head to one side in the main scanning direction;

wherein the control section performs control in the other-side recording operation to eject ink from the second nozzles while moving the ink jet head to the other side in the main scanning direction;

wherein the control section performs control to execute a conveying operation in which the recording medium is conveyed by a length equal to the first pitch P1 or by a length that is obtained by adding multiplication of the second pitch P2 by an integer to the first pitch P1 in the sub-scanning direction, every time any one of the one-side recording operation and the other-side recording operation is executed;

wherein the control section performs control to repeatedly execute the conveying operation to repeatedly execute a unit recording operation for recording an image in a unit recording region of the recording medium extending in the main scanning direction, so as to record an image on the recording medium;

wherein, in the one-side recording operation, ink is attached to a one-side attachment region which is a part of the unit recording region and in which a plurality of dots formed by the attached ink are aligned with respect to the main scanning direction;

wherein, in the other-side recording operation, ink is attached to an other-side attachment region which is a part of the unit recording region and a part other than the one-side attachment region and in which a plurality of dots are aligned with respect to the main scanning direction;

wherein the one-side attachment regions are determined so that an arbitrary one-side attachment region corresponding to an arbitrary unit recording operation and a second one-side attachment region corresponding to at least one unit recording operation among unit recording operations just before and after the arbitrary unit recording operation are in contact with each other with respect to the sub-scanning direction; and wherein the other-side attachment regions are determined so that an arbitrary other-side attachment region corresponding to the arbitrary unit recording operation and a second other-side attachment region corresponding to at least one unit recording operation among unit recording operations just before and after the arbitrary unit recording operation are in contact with each other with respect to the sub-scanning direction.

2. The image recording apparatus according to claim 1;

wherein the control section further includes a changing section for changing positions of the one-side attachment region and the other-side attachment region.

3. The image recording apparatus according to claim 2;

wherein the ink ejected from the first nozzles is black ink, and the ink ejected from the second nozzles is color ink.

4. The image recording apparatus according to claim 1;

wherein the ink ejected from the first nozzles is black ink, and the ink ejected from the second nozzles is color ink.

5. The image recording apparatus according to claim 1;

wherein, in the one-side recording operation, ink is not attached to the other-side attachment region.

6. An image recording apparatus, comprising:

an ink jet head ejecting ink from a plurality of nozzles while reciprocating in a predetermined scanning direction;

a conveyance mechanism conveying a recording medium to which ink ejected from the plurality of nozzles is attached, in a conveying direction perpendicular to the scanning direction; and a control device controlling operation of the ink jet head and the conveyance mechanism;

wherein, as the plurality of nozzles, the ink jet head includes:

a plurality of first nozzles aligned at a predetermined first pitch with respect to the conveying direction; and a plurality of second nozzles aligned at a second pitch with respect to the conveying direction which is a pitch corresponding to a number obtained by multiplying the first pitch by a predetermined integer more than 1 and ejecting ink of a type different from ink ejected from the plurality of first nozzles;

wherein the control device performs control to alternately execute a one-side recording operation and an other-side recording operation for n times;

wherein the control section performs control in the one-side recording operation to eject ink from the first nozzles while moving the ink jet head to one side in the scanning direction;

wherein the control section performs control in the other-side recording operation to eject ink from the first nozzles while moving the ink jet head to the other side in the scanning direction;

wherein the control section performs control to execute a conveying operation in which the recording medium is conveyed by a length equal to the first pitch or by a length obtained by adding multiplication of the second pitch by an integer to the first pitch in the conveying direction, every time any one of the one-side recording operation and the other-side recording operation is executed;

wherein the control section performs control to repeatedly execute the conveying operation to repeatedly execute a unit recording operation for recording an image in a unit recording region of the recording medium extending in the main scanning direction, so as to record an image on the recording medium;

wherein, in the one-side recording operation, ink is attached to a one-side attachment region which is a part of the unit recording region and in which a plurality of dots formed by the attached ink are aligned with respect to the scanning direction;

wherein, in the other-side recording operation, ink is attached to an other-side attachment region which is an image recording region and a part other than the one-side attachment region and in which a plurality of dots are aligned with respect to the scanning direction; and wherein the one-side attachment regions are determined so that an arbitrary one-side attachment region corresponding to an arbitrary unit recording operation and a second one-side attachment region corresponding to at least one unit recording operation among unit recording operations just before and after the arbitrary unit recording operation are overlapped with each other with respect to the conveying direction; and wherein the other-side attachment regions are determined so that an arbitrary other-side attachment region corresponding to the arbitrary unit recording operation and a second other-side attachment region corresponding to at least one unit recording operation among unit recording operations just before and after the arbitrary unit recording operation are overlapped with each other with respect to the conveying direction.

7. The image recording apparatus according to claim 6;

wherein, in the one-side recording operation, ink is not attached to the other-side attachment region.

8. The image recording apparatus according to claim 7;

wherein, in the other-side recording operation, ink is not attached to the one-side attachment region.

* * * * *